US008584390B1

(12) United States Patent
Fraher et al.

(10) Patent No.: US 8,584,390 B1
(45) Date of Patent: Nov. 19, 2013

(54) PISTOL GRIP PANEL WITH VIBRATION DAMPENING STRUCTURE

(71) Applicant: New Colt Holding Corp., West Hartford, CT (US)

(72) Inventors: Mark Fraher, Goshen, CT (US); Gregory Rozum, Thomaston, CT (US)

(73) Assignee: New Colt Holding Corp., West Hartford, CT (US)

( * ) Notice: Subject to any disclaimer, the term of this patent is extended or adjusted under 35 U.S.C. 154(b) by 0 days.

(21) Appl. No.: 13/726,288

(22) Filed: Dec. 24, 2012

Related U.S. Application Data

(63) Continuation-in-part of application No. 29/438,357, filed on Nov. 29, 2012.

(51) Int. Cl.
*F41A 35/00* (2006.01)

(52) U.S. Cl.
USPC ..... 42/71.02

(58) Field of Classification Search
USPC ..... 42/71.02, 74, 71.01, 7; 89/1.42
See application file for complete search history.

(56) References Cited

U.S. PATENT DOCUMENTS 3,722,358 A 3/1973 Seecamp
5,560,136 A * 10/1996 Cupp ..... 42/71.02
7,698,845 B2 4/2010 Hochstrate et al.

* cited by examiner

*Primary Examiner* — Michael Carone
*Assistant Examiner* — Reginald Tillman, Jr.
(74) *Attorney, Agent, or Firm* — Barlow, Josephs & Holmes, Ltd.

(57) ABSTRACT

An elastomeric O-ring compressed between a laminated plastic grip panel and a pistol grip frame provides a vibration dampening structure for a pistol. The elastomeric O-rings are placed around fastener bushings on the grip frame. The grip panels are secured to the grip frame by inserting threaded fasteners through fastener holes in the grip panel into the fastener bushings. Each O-ring is received by the grip panel in a corresponding annular recess that has a depth that is less than the diameter of the O-ring. When the threaded fasteners are tightened, the elastomeric O-rings are compressed between the grip frame and the grip panel. The compressed O-rings prevent loosening of the threaded fasteners by improving the vibration dampening characteristics of the pistol and by increasing frictional pressure between the grip panel and the head of each threaded fastener.

7 Claims, 5 Drawing Sheets

PISTOL GRIP PANEL WITH VIBRATION DAMPENING STRUCTURE

BACKGROUND OF THE INVENTION

The instant invention relates to a handgrip for a pistol and more particularly to a pistol grip panel with a vibration dampening structure to absorb vibrations produced during normal use.

During routine use of a pistol, vibrations in the pistol body are produced when a bullet is fired through the barrel. These vibrations can be transmitted through the entire pistol structure, and over time can loosen the fasteners used to secure a handgrip panel to a pistol frame. Wood and rubber handgrip panels have been traditionally used to provide a gripping surface on a pistol. These materials are inherently elastic and absorb some vibration, thereby preventing loosening of the fasteners.

However, when using a rigid panel that is incompressible, there is a need for additional dampening to limit the ability of the fasteners to loosen during normal operation of the pistol.

SUMMARY OF THE INVENTION

The instant invention provides a vibration dampening structure for use with a rigid handgrip panel, or grip panel, so that vibrations created during routine firing of pistol are less likely to loosen the fasteners securing the rigid panel to the pistol frame. A vibration dampening structure for a pistol grip panel has an elastomeric O-ring compressed between a pistol grip frame and a grip panel.

In order to improve a user's ability to grip a pistol, rigid grip panels formed of laminated plastic may be mounted on opposing sides of the pistol grip frame. Securing the grip panels to the grip frame are fasteners that extend through fastener holes in each grip panel and into fastener bushings extending outwardly from a side surface of the grip frame. The fastener holes on the grip panels are countersunk so the fastener heads may be flush with the grip panel surface when tightened.

To improve the vibration dampening characteristics of the pistol assembly, an elastomeric O-ring is placed around the base portion of each fastener bushing. Each O-ring is received by the grip panel in an annular recess that has a depth that is less than the diameter of an uncompressed O-ring. Thus, tightening of the threaded fasteners compresses an elastomeric O-ring having a circular cross section into a more elliptical cross section. The compressed O-ring improves the vibration dampening characteristics of the pistol grip frame assembly. Also, placement of the elastomeric O-ring between the grip frame and grip panel rather than between the grip panel and the threaded fastener increases the frictional pressure between the grip panel and the head of each threaded fastener and protects the O-ring from frictional wear due to tightening and loosening of the threaded fasteners.

Accordingly, among the objects of the instant invention are: the provision of an elastomeric O-ring that forms a vibration dampening structure for a pistol grip panel; and the provision of an elastomeric O-ring that increases the frictional pressure between the grip panel and a threaded fastener head.

Other objects, features and advantages of the invention shall become apparent as the description thereof proceeds when considered in connection with the accompanying illustrative drawings.

DESCRIPTION OF THE DRAWINGS

In the drawings, which illustrate the best mode presently contemplated for carrying out the present invention.

DESCRIPTION OF THE PREFERRED EMBODIMENT

Figure 1:
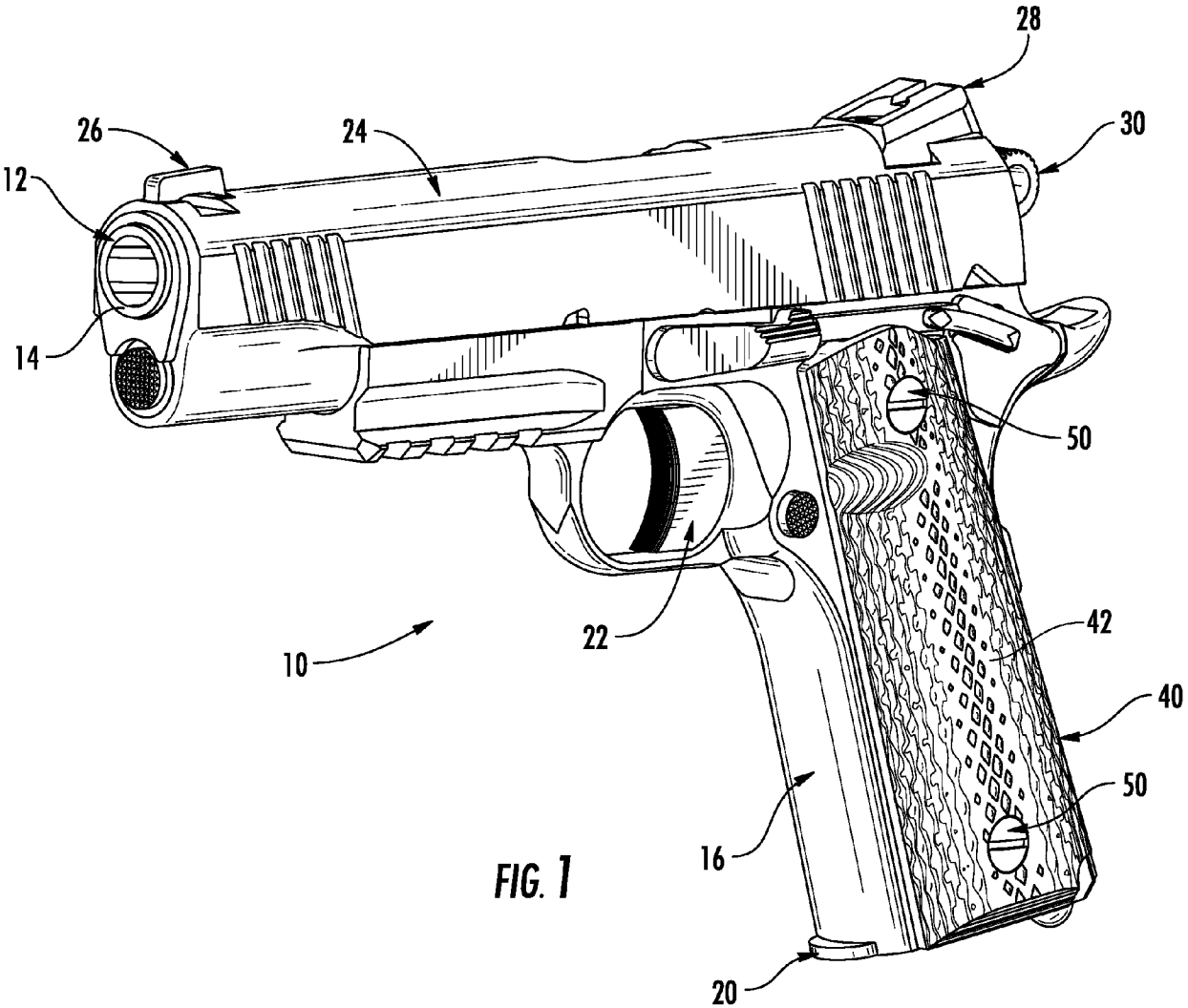
FIG. 1 is a perspective view of a pistol grip panel with vibration dampening structure mounted on a pistol.

Referring now to the drawings, the pistol grip panel with vibration dampening structure of the instant invention is illustrated in FIGS. 1-5.

Vibrations caused by firing a bullet from a firearm over time can loosen the fasteners that secure a handgrip panel, or grip panel, to a firearm. The grip panel with vibration dampening structure of the present invention allows a user to secure the grip panel to a grip frame of a firearm and enjoy extended use of the firearm with decreased risk of the grip panel loosening from the firearm. As will hereinafter be more fully described, this is accomplished by an elastomeric O-ring that is compressed between a firearm frame and a corresponding recessed surface on the grip panel. This O-ring forms a vibration dampening structure for a firearm grip panel, and it also increases the frictional pressure between the grip panel and the fasteners securing the grip panel to the firearm.

Figure 2:
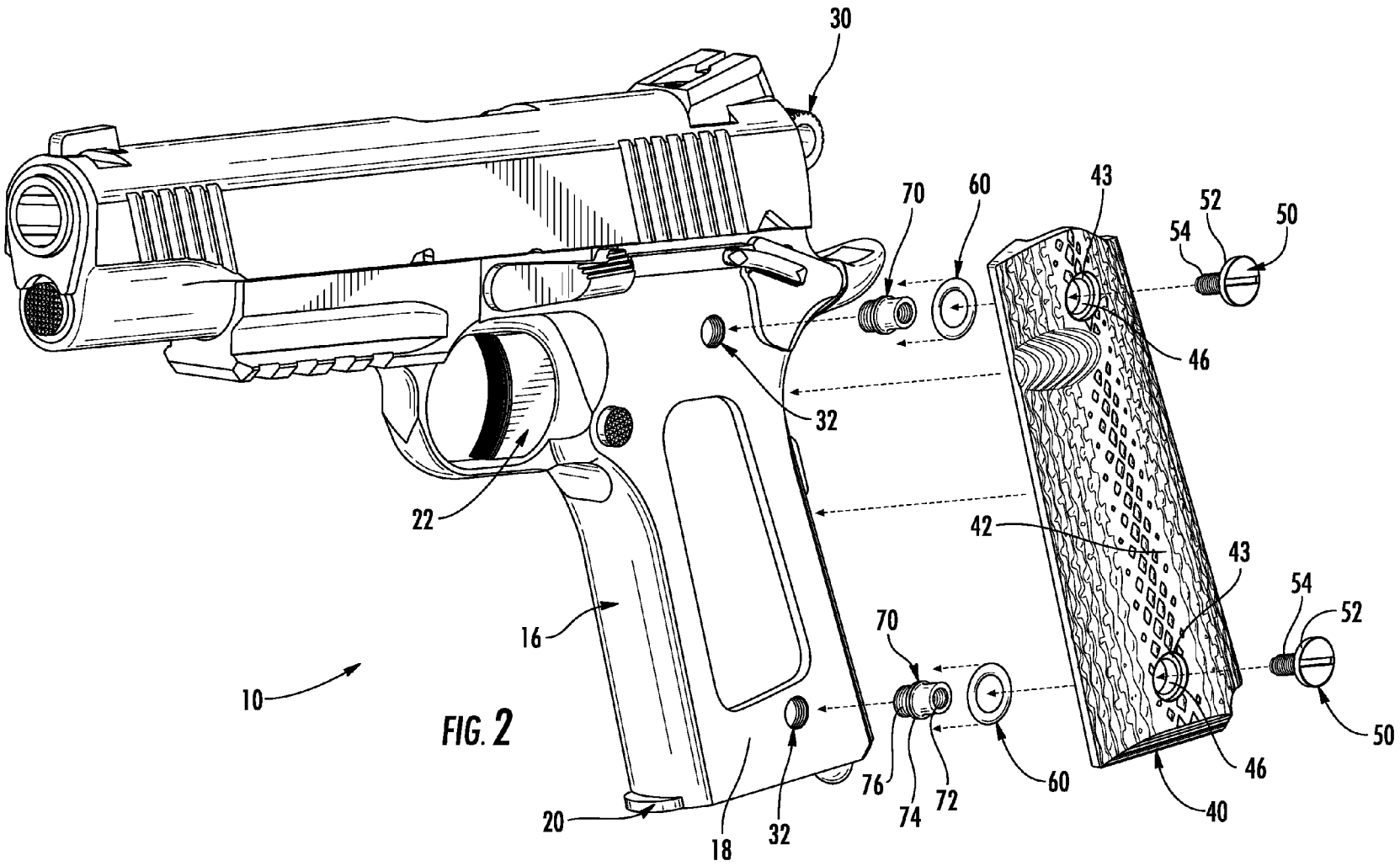
FIG. 2 is an exploded view thereof.
Figure 3:
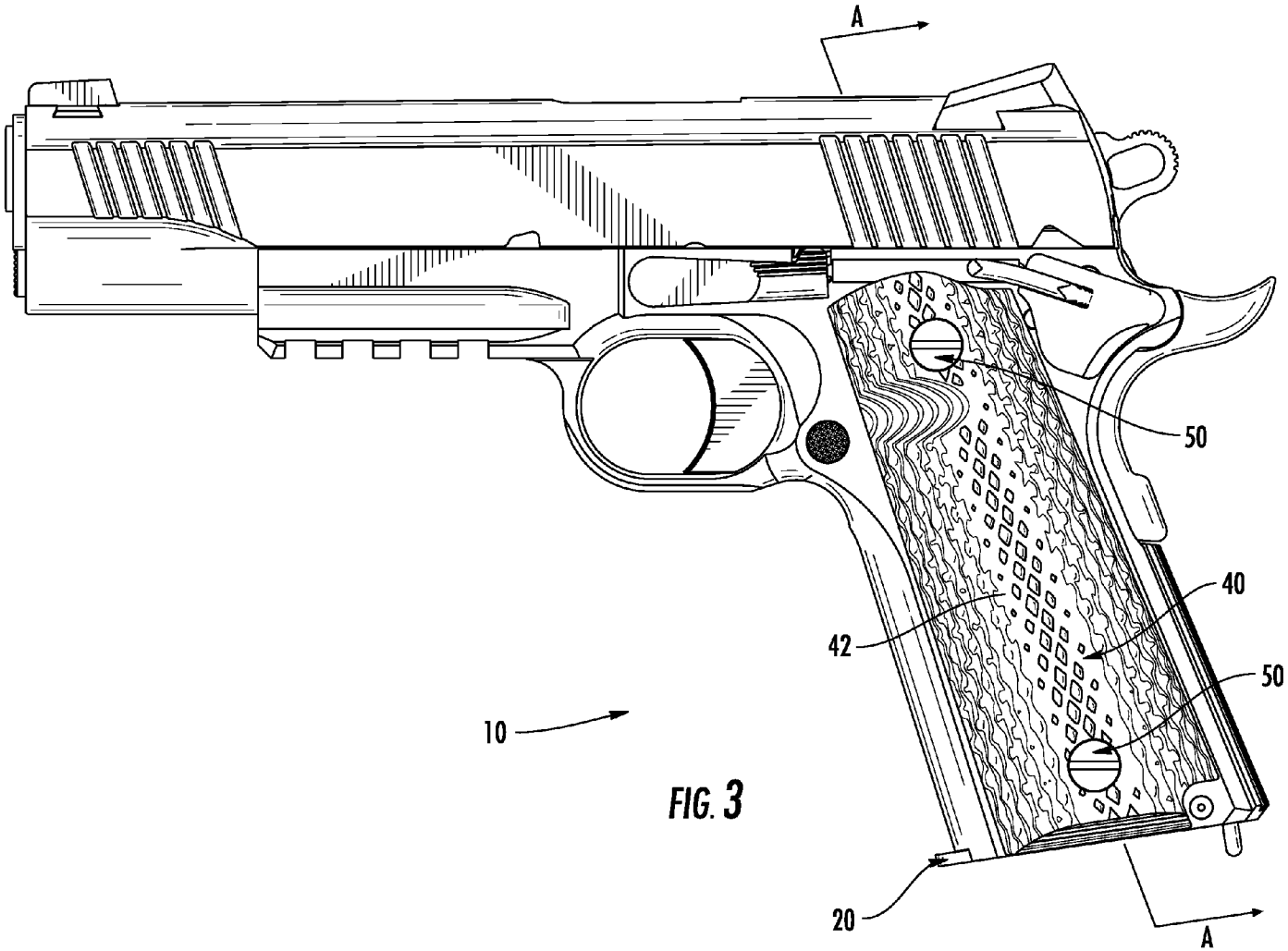
FIG. 3 is a side view thereof.

In one embodiment, the present invention may be used in conjunction with a pistol 10, such as a model 1911 semi-automatic pistol, as discussed in more detail below and as shown in FIGS. 1-3. When fully assembled, as in FIG. 1, the elastomeric O-ring 60 of the present invention is not visible under the grip panel 40 that is secured to the pistol frame 16.

The exploded view of the present invention provided in FIG. 2 shows in more detail how the grip panel 40 with vibration dampening structure is mounted on a pistol 10 that may be otherwise fully assembled. This mounting process is more clearly illustrated in the cross-sectional views provided by FIGS. 4 and 5. The process is shown for securing one grip panel 10 to one side of the grip frame 16, and it may be repeated for securing a second grip panel 40 to the opposite side of the grip frame 16.

The pistol 10 of FIGS. 1-3 has, among other features, a barrel 12 having a barrel opening 14 located at the front end of the pistol 10 and a grip frame 16 located at the other rear end of the pistol 10. The pistol grip frame 16 has two opposing flat side surfaces 18 to which grip panels 40 can be secured.

To attach a grip panel 40 to the grip frame 16, two fastener bushings 70 are placed in threaded bushing holes 32 on a side surface 18 of the grip frame 16. An outwardly threaded portion 76 of each fastener bushing 70 engages a threaded bushing hole 32 on the side surface 18 so that a base portion 74 of each fastener bushing 70 is seated on the side surface 18. Each fastener bushing 70 has an inwardly threaded neck portion 72 extending upwardly from the base portion 74 for receiving a threaded fastener 50, as discussed below.

Figure 4:
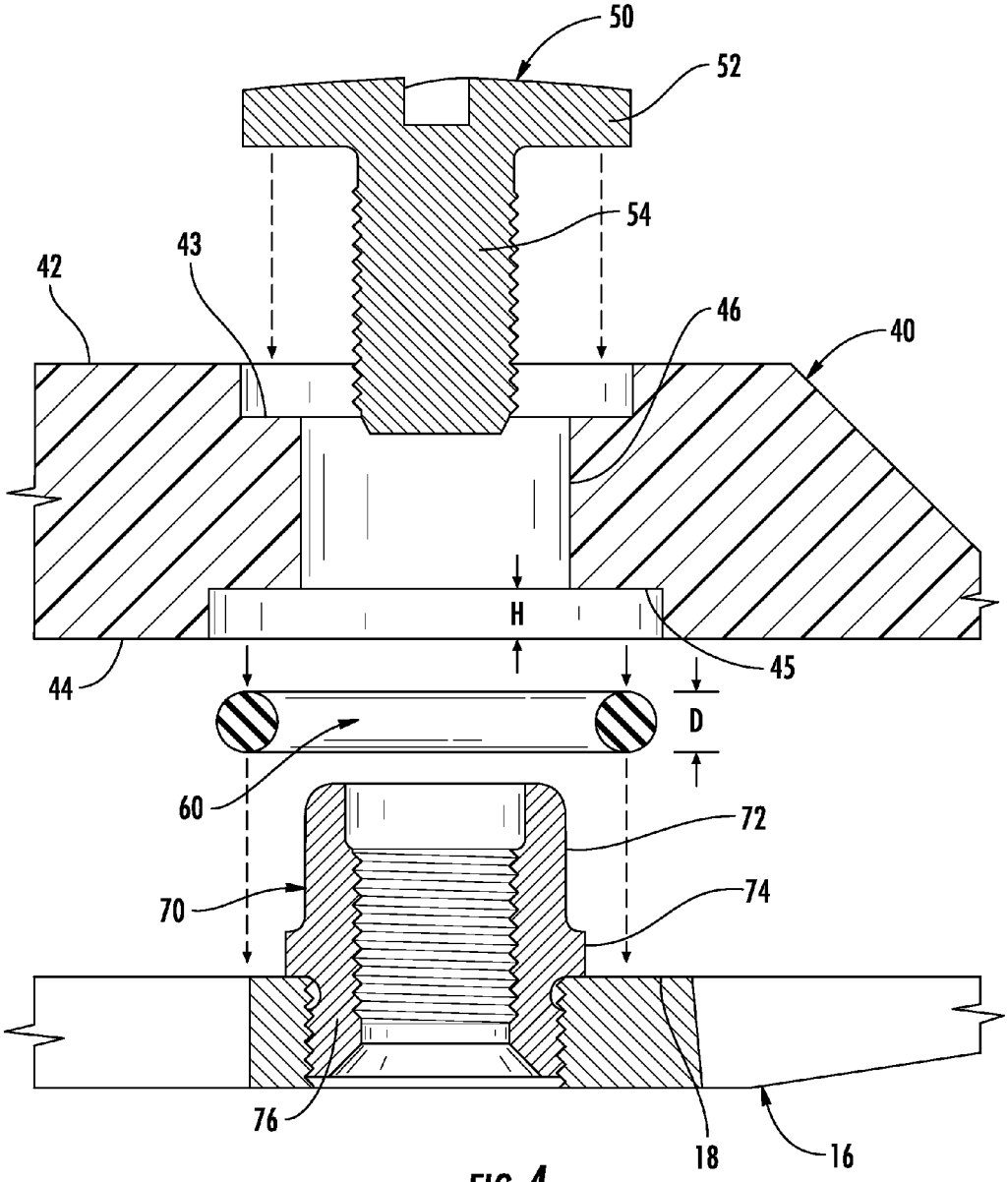
FIG. 4 is an exploded cross-sectional view of the pistol grip panel with vibration dampening structure.

Next, an elastomeric O-ring 60 is placed around the base portion 74 of each fastener bushing 70. Although FIG. 4 shows the elastomeric O-ring 60 of the present embodiment having a cylindrical cross section, other cross-sectional shapes are possible without departing from the scope of the present invention.

Next, a grip panel 40 having two fastener holes 46 is placed over the side surface 18 so that the inner surface 44 of the panel 40 is in facing relation with the side surface 18 of the grip frame 16 and the fastener holes 46 are aligned with the fastener bushings 70. As the grip panel 40 is moved towards the side surface 18 of the grip frame 16, the neck portion 72 of each fastener bushing 70 extends into its respective fastener hole 46 and each elastomeric O-ring 60 extends into an annular recess 45 that surrounds each fastener hole 46 on the inner surface 44 of the grip panel 40 (see FIGS. 4-5).

The elastomeric O-ring 60 is designed to have a diameter D that is greater than the depth H of the annular recess 45. Thus, when the annular recess 45 rests against the elastomeric O-ring 60 without application of external force on the grip panel 40, the inner surface 44 of the grip panel 40 will not be in direct contact with the side surface 18 of the grip frame 16.

Figure 5:
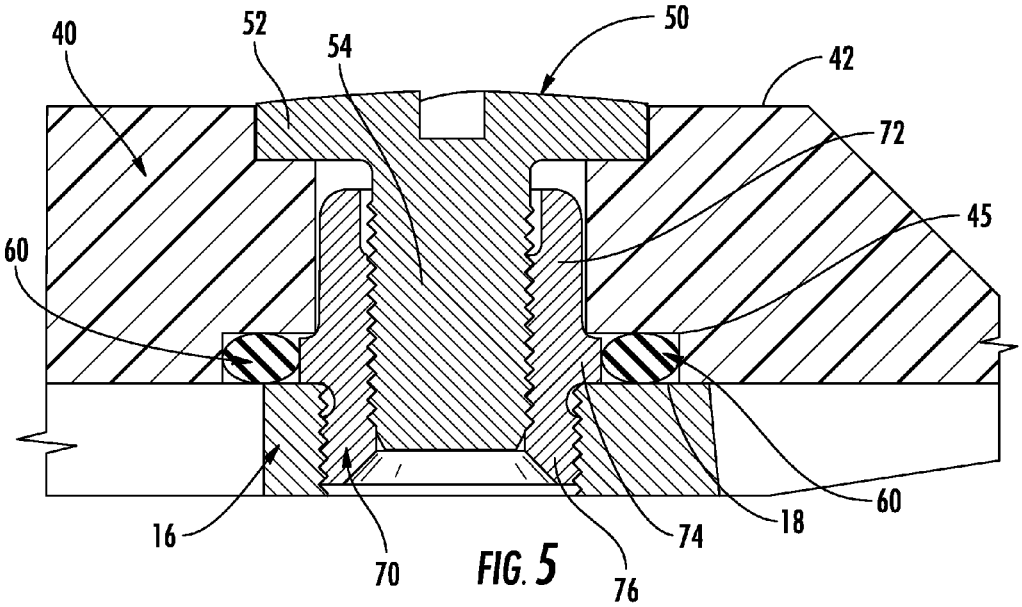
FIG. 5 is a cross-sectional view of the pistol grip panel with vibration dampening structure.

In order to secure the grip panel 40 to the grip frame 16, a threaded fastener 50 having a threaded shank portion 54 is tightened into the inwardly threaded neck portion 72 of each fastener bushing 70. When tightened, the head portion 52 of the threaded fastener 50 is seated on a countersunk surface 43 surrounding the fastener hole 46 on the outer surface 42 of the grip panel 40. In this position, as shown in FIG. 5, the inner surface 44 of the grip panel 40 contacts the side surface 18 of the grip frame 16 and the elastomeric O-ring 60 is compressed to fit within the annular recess 45. When comparing FIGS. 4 and 5, the compression of the O-ring 60 is visible, as the cross-sectional shape changes from circular in FIG. 4 to elliptical in FIG. 5.

The compressed O-ring 60 in FIG. 5 provides vibration dampening between the grip frame 16 and the grip panel 40. The compressed O-ring 60 also exerts a linear outward force on the grip panel 40, thus providing frictional pressure between the countersunk portion 43 of the grip panel 40 and the head portion 52 of the threaded fastener 50, which restricts loosening of the threaded fastener 50.

Placement of the O-ring 60 between the grip frame 16 and the grip panel 40 rather than between the grip panel 40 and the threaded fastener head 52 protects the O-ring 60 from wear caused by tightening and loosening of the threaded fastener 50. Frictional contact between the fastener head 52 and the O-ring 60 can create torsional loads on the O-ring 60 and wear down or destroy the O-ring 60. This can result in decreased dampening performance or complete loss of O-ring dampening altogether. With the O-ring 60 protected from the threaded fastener head portion 52 by the grip panel 40 and protected from the threaded fastener shank portion 54 by the fastener bushing 70, there is no risk of O-ring 60 degradation caused by direct contact with the threaded fastener 50. Furthermore, tightening the threaded fasteners 50 of the present invention does not create a torsional load on the O-ring 60, but instead only a vertical load as the O-ring 60 is compressed as illustrated in FIG. 5.

Although the embodiment shown in FIGS. 1-5 includes a fastener bushing 70 around which the elastomeric O-ring 60 can be placed, other embodiments may use a different structure to aid in placement of the O-ring 60 without departing from the scope of the present invention. For example, the fastener bushing 70 could be excluded if the annular recess 45 were designed to be a groove with an inner sidewall and an outer sidewall in order to control the location of the O-ring during assembly. Without the fastener bushing 70, the threaded fastener 50 could be received directly by a threaded hole in the side surface 18 of the grip frame 16. Other embodiments are also possible.

Additional dampening structures can be incorporated without departing from the scope of the present invention. Although the O-rings 60 improve the dampening characteristics of a firearm, additional dampening structures could be used to further modify the frequency response characteristics of the firearm.

The grip panel 40 can itself be modified to adjust the frequency response characteristics of the firearm. As mentioned above, a grip panel 40 formed of laminated plastic is generally more rigid than a grip panel formed of other common materials, such as wood or rubber. More rigid grip panels require additional dampening to prevent the threaded fasteners from loosening over an extended period of use of the firearm. However, the present invention could alternatively incorporate less rigid grip panels formed of materials such as wood and rubber to improve their frequency response characteristics.

Additional changes may be made to other features of the grip panel 40, such as its outer surface 42. For example, the outer surface of a grip panel may be textured as shown in FIGS. 1-3 to make the firearm easier to grip, or it may have another outer contour.

Although not critical to the present invention, the pistol 10 to which the grip panel with vibration dampening structure is attached includes common features such as a breach slide 24, a trigger assembly 22, a hammer assembly 30, a front sight 26, a rear sight 28, and a removable cartridge magazine 20. As shown in FIG. 2, the grip panel 40 with vibration dampening structure may be attached to and detached from a pistol without interfering with the operation of these and other components of the firearm.

Because of the improved vibration dampening of the present invention, a manufacturer may choose to design and produce firearms incorporating the grip panels of the present invention. These firearms may be pistols, such as the one illustrated in FIGS. 1-3, or any other firearm having a surface capable of supporting a grip panel. However, some embodiments of the invention do not require the inclusion of a firearm. Because of the ease with which a consumer can attach a replacement grip panel to a previously sold firearm, the grip panel can be provided to a consumer as a kit including only a grip panel 40, elastomeric O-rings 60 and threaded fasteners 50.

It can therefore be seen that the pistol grip panel of the present invention provides an elastomeric O-ring 60 that both forms a vibration dampening structure for a pistol grip panel 40 and that increases the frictional pressure between the grip panel 40 and a threaded fastener head 52. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A pistol grip replacement kit for use with a pistol grip frame having a side surface and a fastener bushing extending outwardly from said side surface of said grip frame, said fastener bushing including a base portion and an inwardly threaded neck portion extending upwardly from said base portion, said pistol grip replacement kit comprising:

a grip panel having an outer surface and an inner surface which is capable of being received in facing relation with said side surface of said pistol grip frame, said grip panel including a fastener hole extending therethrough, wherein said fastener hole is surrounded by a countersunk surface on said outer surface of said grip panel, and further wherein said fastener hole is surrounded by an annular recess on said inner surface of said grip panel, said fastener hole being formed so that it may be aligned with said fastener bushing on said side surface of said grip frame whereby said fastener bushing is capable of being received through said fastener hole when said grip panel is received in facing relation with said grip frame;

an elastomeric O-ring capable of being received around said base portion of said fastener bushing and within said annular recess surrounding said fastener hole, said O-ring having an outer diameter that is greater than a depth of said annular recess;

a threaded fastener having a shank portion capable of being received through said fastener hole and into said inwardly threaded neck in said fastener bushing and a head portion thereof seated in said countersunk surface surrounding said fastener hole, said threaded fastener being capable of being tightened to secure said grip panel to said grip frame wherein said O-ring is compressed between said outer surface of said grip frame and said grip panel to provide vibration dampening between said grip frame and said grip panel and frictional pressure between said grip panel and said head portion of said threaded fastener to thereby restrict loosening of said threaded fastener.

2. The grip kit of claim 1, wherein the grip panel comprises a rigid, laminated plastic structure.

3. A pistol comprising:

a grip frame having a side surface;

a fastener bushing extending outwardly from said side surface of said grip frame, said fastener bushing including a base portion and an inwardly threaded neck portion extending upwardly from said base portion;

a grip panel having an outer surface and an inner surface which is received in facing relation with said side surface of said grip frame, said grip panel including a fastener hole extending therethrough, wherein said fastener hole is surrounded by a countersunk surface on said outer surface of said grip panel, and further wherein said fastener hole is surrounded by an annular recess on said inner surface of said grip panel, said fastener hole being formed in alignment with said fastener bushing whereby said fastener bushing is received through said fastener hole when said grip panel is received in facing relation with said grip frame;

an elastomeric O-ring received around said base portion of said fastener bushing and within said annular recess surrounding said respective fastener hole, said O-ring having an outer diameter that is greater than a depth of said annular recess;

a threaded fastener having a threaded shank portion received through said fastener hole and into said inwardly threaded neck in said fastener bushing and a head portion thereof seated in said countersunk surface surrounding said fastener hole, said threaded fastener being tightened to secure said grip panel to said grip frame wherein said O-ring is compressed between said outer surface of said grip frame and said grip panel to provide vibration dampening between said grip frame and said grip panel and frictional pressure between said grip panel and a head portion of said threaded fastener to thereby restrict loosening of said threaded fastener.

4. The pistol of claim 3, wherein said grip panel comprises a rigid, laminated plastic structure.

5. A pistol comprising:

a grip frame having opposing side surfaces;

a plurality of fastener bushings extending outwardly from said opposing side surfaces of said grip frame, said fastener bushings each including a base portion and an inwardly threaded neck portion extending upwardly from said base portion;

an opposed pair of grip panels, each grip panel having an outer surface and an inner surface which is received in facing relation with a corresponding side surface of the grip frame, each of said grip panels including a plurality of spaced fastener holes extending therethrough, wherein each fastener hole is surrounded by a countersunk surface on said outer surface of said grip panel, and further wherein each fastener hole is surrounded by an annular recess on said inner surface of said grip panel, said plurality of fastener holes being formed in alignment with said plurality of fastener bushings whereby said fastener bushings are received through said fastener holes when said grip panels are received in facing relation with said grip frame;

a plurality of elastomeric O-rings each respectively received around said base portion of said respective fastener bushing and within said respective annular recess surrounding said respective fastener hole, each O-ring having an outer diameter that is greater than a depth of said annular recess;

a plurality of threaded fasteners each having a threaded shank portion received through a respective fastener hole and into said inwardly threaded neck in said respective fastener bushing and a head portion thereof seated in said countersunk surface surrounding said fastener hole, said threaded fasteners being tightened to secure said grip panels to said grip frame wherein said O-rings are compressed between said outer surface of said grip frame and said grip panel to provide vibration dampening between said grip frame and said grip panels and frictional pressure between said grip panel and a head portion of said threaded fastener to thereby restrict loosening of said threaded fastener.

6. The pistol of claim 5, wherein said grip panels each comprise a rigid, laminated plastic structure.

7. The pistol of claim 5, wherein said plurality of fastener bushings consists of four fastener bushings;

wherein said plurality of elastomeric O-rings consists of four elastomeric O-rings; and wherein said plurality of threaded fasteners consists of four threaded fasteners.

* * * * *